US011684129B2

(12) United States Patent
Ma

(10) Patent No.: US 11,684,129 B2
(45) Date of Patent: Jun. 27, 2023

(54) SHADE STRUCTURE ASSEMBLIES AND COMPONENTS

(71) Applicant: Zhun-an Ma, Ningbo (CN)

(72) Inventor: Zhun-an Ma, Ningbo (CN)

( * ) Notice: Subject to any disclaimer, the term of this patent is extended or adjusted under 35 U.S.C. 154(b) by 0 days.

(21) Appl. No.: 17/213,967

(22) Filed: Mar. 26, 2021

(65) Prior Publication Data

US 2021/0298436 A1 Sep. 30, 2021

Related U.S. Application Data

(60) Provisional application No. 63/001,108, filed on Mar. 27, 2020.

(51) Int. Cl.
*A45B 25/10* (2006.01)

(52) U.S. Cl.
CPC ..... *A45B 25/10* (2013.01)

(58) Field of Classification Search
CPC ..... A45B 25/02; A45B 2023/0087
USPC ..... 135/129
See application file for complete search history.

(56) References Cited

U.S. PATENT DOCUMENTS

| | | | |
|---|---|---|---|
| 331,231 | A | 11/1885 | Folger |
| 501,089 | A | 7/1893 | Lichtenstein |
| 620,815 | A | 3/1899 | Warren |
| 770,704 | A | 9/1904 | Vogel |
| 880,534 | A | 3/1908 | Hoyt |
| 897,026 | A | 8/1908 | Seitzinger |
| 928,169 | A | 7/1909 | Bardon |
| 941,952 | A | 11/1909 | Riehl |
| 947,790 | A | 2/1910 | Carter |
| 959,127 | A | 5/1910 | Edwards |
| 1,001,076 | A | 8/1911 | Redford |
| 1,107,415 | A | 8/1914 | Drohan |
| 1,264,075 | A | 4/1918 | Hout |
| 1,469,495 | A | 10/1923 | Bunker |

(Continued)

FOREIGN PATENT DOCUMENTS

| | | |
|---|---|---|
| CA | 1269018 | 5/1990 |
| CN | 201061309 | 5/2008 |

(Continued)

OTHER PUBLICATIONS

EPO Extended Search Report dated Apr. 5, 2011 for European Patent No. 09252140.0, filed Sep. 7, 2009.
Treasure Garden, 2010 Products Catalog, pp. 20 and 60.

*Primary Examiner* — Noah Chandler Hawk
(74) *Attorney, Agent, or Firm* — Knobbe, Martens, Olson & Bear, LLP

(57) ABSTRACT

A rib end connector, a plug to receive a rib socket, or a rib to be coupled with an upper or lower hub of a shade structure is provided that has a pin connection portion that has a first end configured to be disposed in a channel of an umbrella or other shade structure hub. The apparatus has a second portion opposite the first portion, a first side surface, and a second side surface. A circumferential width of the pin connection portion is defined between the first and second lateral surfaces. A pin channel disposed between the first side surface and the second side surface. The pin channel has a narrowest portion disposed between the first side surface and the second side surface and increases in size between the narrowest portion and the first side surface and/or the second side surface.

18 Claims, 6 Drawing Sheets

(56) References Cited

U.S. PATENT DOCUMENTS

| | | | | |
|---|---|---|---|---|
| 2,207,043 | A | 7/1940 | Weiss et al. | |
| 2,321,495 | A | 6/1943 | Levin | |
| 2,336,116 | A | 12/1943 | Morando | |
| 2,385,575 | A | 9/1945 | Isler | |
| 2,469,637 | A | 5/1949 | Evans | |
| 2,635,616 | A | 4/1953 | Haydu | |
| 2,762,383 | A | 9/1956 | Wittman | |
| 2,796,073 | A | 6/1957 | Wittman | |
| 2,860,647 | A | 11/1958 | Negri | |
| 2,914,154 | A | 11/1959 | Russell | |
| 3,177,882 | A | 4/1965 | Militano | |
| 3,330,582 | A | 7/1967 | Morris | |
| 3,431,925 | A * | 3/1969 | Kraft | A45B 25/02 135/25.31 |
| 3,462,179 | A | 8/1969 | Hinkle | |
| 3,557,809 | A | 1/1971 | Vazquez et al. | |
| 3,643,673 | A | 2/1972 | Weber | |
| 3,704,479 | A | 12/1972 | Whitaker | |
| 4,201,237 | A | 5/1980 | Watts et al. | |
| 4,368,749 | A | 1/1983 | Lindler et al. | |
| 4,369,000 | A | 1/1983 | Egnew | |
| 4,673,308 | A | 6/1987 | Reilly | |
| 4,750,509 | A | 6/1988 | Kim | |
| D320,111 | S | 9/1991 | Ma | |
| 5,056,291 | A | 10/1991 | Leung | |
| 5,085,239 | A | 2/1992 | Chin-Hung | |
| 5,188,137 | A | 2/1993 | Simonelli | |
| 5,193,566 | A | 3/1993 | Chen | |
| 5,328,286 | A | 7/1994 | Lee | |
| 5,433,233 | A | 7/1995 | Shiran et al. | |
| 5,445,471 | A | 8/1995 | Wexler et al. | |
| 5,556,291 | A | 9/1996 | Ito | |
| 5,715,853 | A | 2/1998 | Lin | |
| 5,738,129 | A | 4/1998 | Vogt | |
| 5,740,824 | A | 4/1998 | Tang | |
| 5,797,613 | A | 8/1998 | Busby | |
| 6,076,540 | A | 6/2000 | You | |
| 6,095,169 | A | 8/2000 | Lin et al. | |
| 6,311,706 | B1 | 11/2001 | Sato | |
| 6,314,976 | B1 | 11/2001 | Clarke | |
| 6,332,657 | B1 | 12/2001 | Fischer | |
| 6,345,637 | B1 | 2/2002 | Ko | |
| 6,374,840 | B1 | 4/2002 | Ma | |
| 6,386,215 | B1 | 5/2002 | Chang | |
| 6,397,867 | B2 | 6/2002 | You | |
| 6,643,889 | B1 | 11/2003 | Kotlarski | |
| 6,701,946 | B2 | 3/2004 | You | |
| 6,705,335 | B2 | 3/2004 | You | |
| 6,758,228 | B1 | 7/2004 | You | |
| 6,814,093 | B2 | 11/2004 | You | |
| 7,178,535 | B2 | 2/2007 | Eder | |
| 7,574,777 | B1 | 8/2009 | Fuller et al. | |
| 7,703,464 | B2 | 4/2010 | Ma | |
| 7,891,367 | B2 | 2/2011 | Ma | |
| 8,061,375 | B2 | 11/2011 | Ma | |
| 8,082,935 | B2 | 12/2011 | Ma | |
| 8,166,986 | B2 | 5/2012 | Ma | |
| 2004/0123889 | A1* | 7/2004 | Liang | A45B 25/02 135/29 |
| 2004/0123891 | A1 | 7/2004 | Ma | |
| 2005/0115599 | A1 | 6/2005 | You | |
| 2006/0124160 | A1 | 6/2006 | Lee | |
| 2007/0172310 | A1 | 7/2007 | Yang et al. | |
| 2009/0056776 | A1 | 3/2009 | Ma | |
| 2009/0126769 | A1 | 5/2009 | Hoogendoorn | |
| 2010/0059094 | A1 | 3/2010 | Ma | |
| 2010/0224225 | A1 | 9/2010 | Ma | |

FOREIGN PATENT DOCUMENTS

| | | |
|---|---|---|
| EP | 2 460 432 | 6/2012 |
| FR | 002650491 | 2/1991 |
| GB | 2113543 | 8/1983 |
| JP | 61131921 | 8/1986 |
| KR | 100851744 | 8/2008 |
| WO | WO 2005/023042 | 3/2005 |

* cited by examiner

SHADE STRUCTURE ASSEMBLIES AND COMPONENTS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND

Field of the Invention

This application is directed to shade structures, assemblies, and components, including umbrella assemblies and components.

Description of the Related Art

Umbrellas typically have a symmetrical configuration with an umbrella pole in the center of a canopy assembly. The canopy assembly can include upper and lower hubs with rib members that are foldable and extendable. When extended the umbrella ribs extend a shade-providing canopy over the rib members and pole. The rib members extend radially in a symmetrical manner from the hub or hubs.

SUMMARY

It is desired to provide shade structures and components therefor that can provide non-symmetrical shade structure and umbrella configurations. For example, a rectangular umbrella can be provided. Ribs can be supported from a central hub. The ribs can extend from the central hub to a periphery of the canopy. Some of the ribs extend radially from the hub to the periphery of the canopy. Some of the ribs extend along a direction angled from a radial direction.

In one embodiment an umbrella rib apparatus is provided. The apparatus can be a rib end connector, a plug to receive a rib socket, or a rib to be coupled with an upper or lower hub of an umbrella or other shade structure. The apparatus includes a pin connection portion that has a first end configured to be disposed in a channel of an umbrella or other shade structure hub. The apparatus has a second portion opposite the first portion, a first side surface and a second side surface. A circumferential width of the pin connection portion is defined between the first and second lateral surfaces. A pin channel disposed between the first side surface and the second side surface. The pin channel has a narrowest portion disposed between the first side surface and the second side surface. The pin channel increases in size along at least one direction between the narrowest portion and the first side surface and/or the second side surface.

The pin channel can increase in size in a radial direction. The pin channel can have a constant height from the first side surface to the second side surface. The pin channel can enlarge symmetrically from the narrowest portion to the first side surface and to the second side surface. The pin channel comprises an hourglass shape in longitudinal cross-section.

At least one of the first side surface and the second side surface can be tapered toward the first end of the pin connection portion. The first side surface and the second side surface can both be tapered toward the first end.

BRIEF DESCRIPTION

Features of the invention can be better understood from the following detailed description when read in conjunction with the accompanying schematic drawings, which are for illustrative purposes only. The drawings include the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
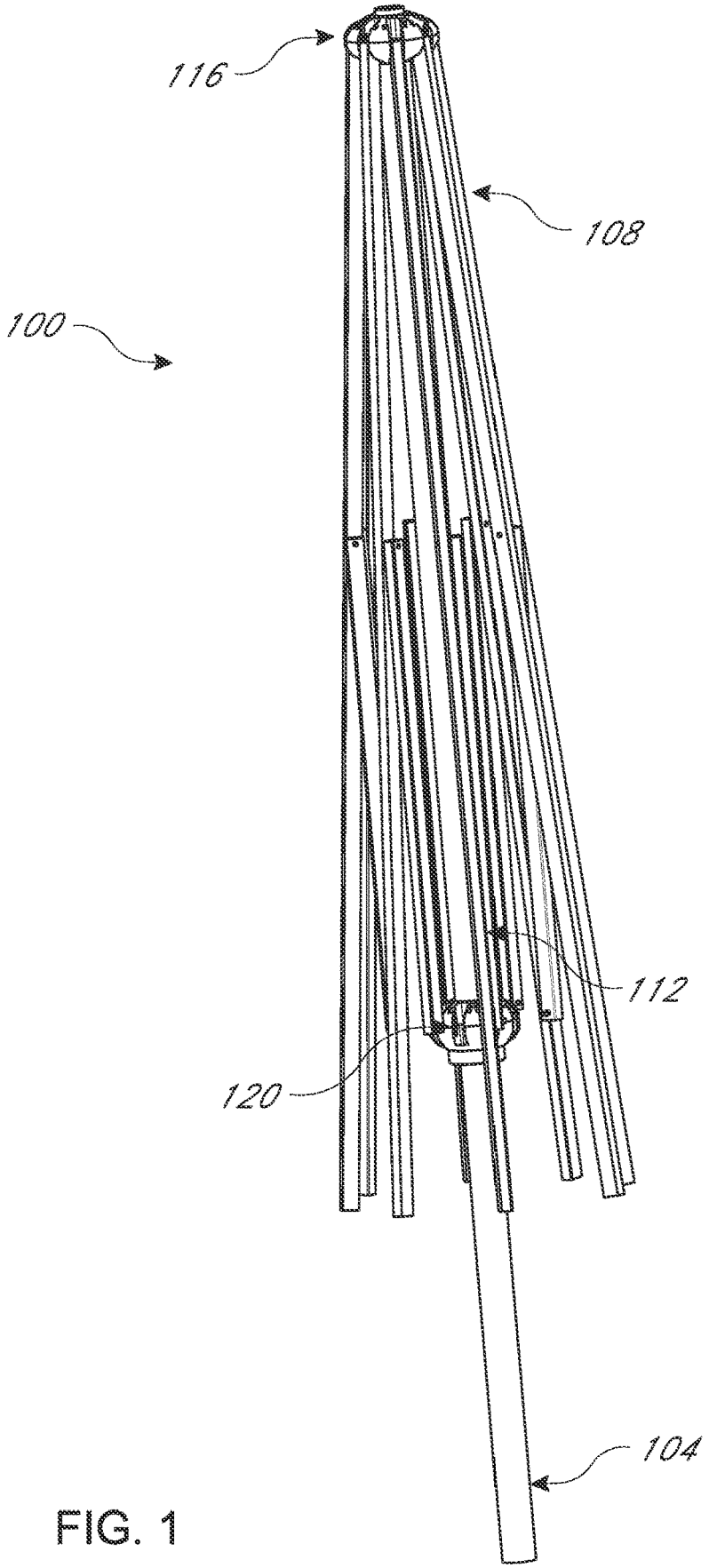
FIG. 1 is an example of a market umbrella that can include a novel rib end connector.

This application discloses an inventive umbrella and other shade structures and components for the same. FIG. 1 shows an assembly 100 of an umbrella. The assembly includes an umbrella pole 104 and canopy frame that includes an upper hub 116 and a lower hub 120. In this umbrella assembly 100 the lower hub 120 is moveable along the umbrella pole 104 between a lowered position (as shown in FIG. 1) and a raised position (not shown but between the lowered position and the position of the upper hub 116). The upper hub 116 and the lower hub 120 are connected to each other by a framework of rib members, including upper ribs 108 and lower ribs 112. The upper ribs 108 are secured at a first end to the upper hub 116 and at an end opposite the first end to a canopy member, e.g., fabric (not shown). The lower ribs 112 are connected to the lower hub 120 at a first end and to a point along the length of the upper ribs 108 at a second end opposite the first end.

Figure 2:
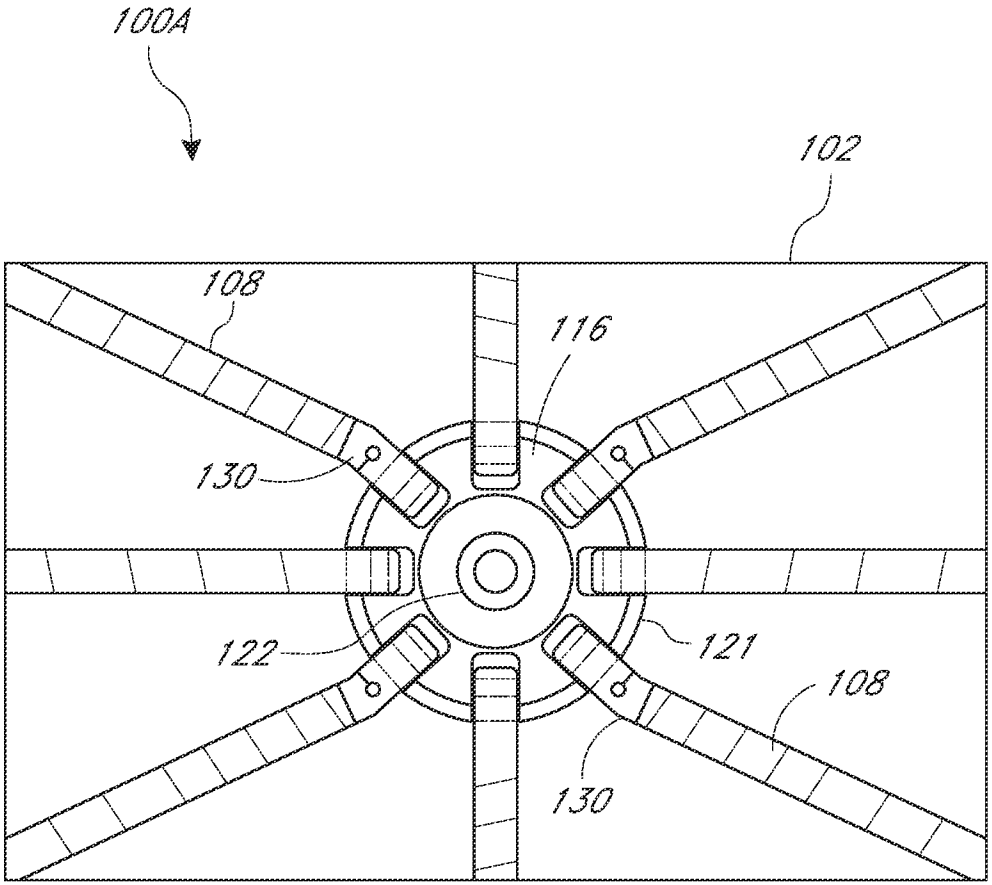
FIG. 2 is bottom view of a non-symmetrical, e.g., a rectangular, umbrella canopy assembly that can include a novel rib end connector.

The umbrella assembly 100 is often used for a shade structure that is symmetrical about the umbrella pole 104, e.g., a circular, square, hexagon, or similar shape. FIG. 2 shows a modified embodiment of an umbrella 100A, which includes a frame structure to be mounted to a pole, similar to that shown in FIG. 1. The umbrella 100A includes a canopy fabric 102. The umbrella 100A differs in providing an asymmetric shape, in this illustrated embodiment a rectangular shape. The umbrella 100A includes the upper hub 116 and a plurality of upper ribs 108 that extend from the upper hub 116 to a periphery of the canopy fabric 102. As can be seen some of the upper ribs 108 extend along a radius of the upper hub 116, e.g., radially relative to the upper hub 116. These hubs are seen at 3, 6, 9, and 12 o'clock in FIG.

2. Four of the upper ribs 108 extend at a different orientation to the upper hub 116. FIG. 2 shows that the umbrella 100A has a connector 130 that is configured to bend along the length thereof at a point between the end of a tubular member of the upper ribs 108 and the radially inner end of the connector 130. The bending of the connector 130 enables the longitudinal axis of the tubular member to be angled relative to a radial direction of the upper hub 116.

Figure 3:
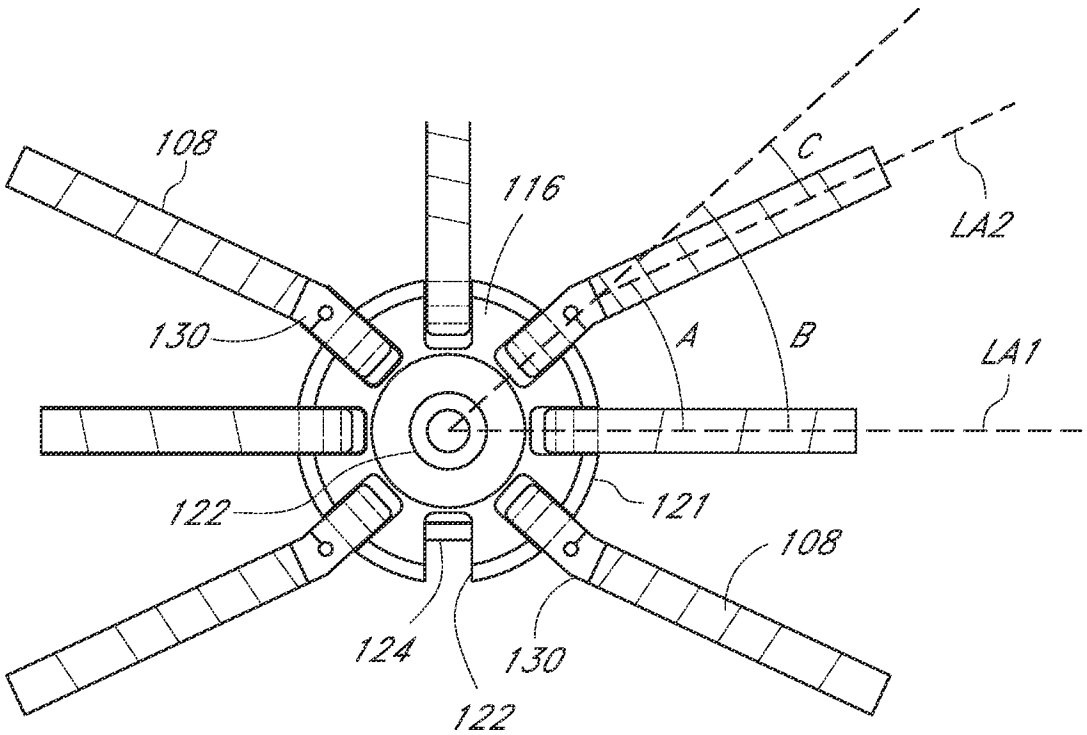
FIG. 3 is a view of a rib and hub assembly showing deflection of some ribs thereof to provide different angles of ribs extending from hubs thereof.

FIG. 3 shows the angulation in more detail. The upper hub 116 can have a hub periphery 121 and a central aperture 123 disposed at a center of the upper hub 116. The hub periphery 121 and the central aperture 123 can be circular and a line extending perpendicularly between these circular structures can be along a radial direction. The upper ribs 108 can be coupled with the upper hub 116 in the channel 122. The upper ribs 108 can be secured to a pin 124 coupled with the body of the upper hub 116. With reference to the upper ribs 108 disposed at the 3 o'clock position, the upper rib 108 can be disposed in the channel 122 at 3 o'clock and can extend radially away from the channel 122 and a longitudinal axis LA1. An angle B can be defined between the channel 122 in which the upper rib 108 at the 3 o'clock position is secured and an adjacent channel 122 located counterclockwise from the 3 o'clock position. The angle B can separate each channel 122 and the channel 122 located adjacent thereto. The connector 130 can bend to allow the upper rib 108 in the channel 122 adjacent to and counterclockwise of the 3 o'clock position to extend along a longitudinal axis LA2. The longitudinal axis LA2 can be disposed at an angle A from the longitudinal axis LA1. As a result, an angle C can be defined between the longitudinal axis LA2 and the radial direction of the channel 122 to which the upper rib 108 having the longitudinal axis LA2 is coupled. The connector 130 is useful but due to the bending at the narrow portion thereof, the connector 130 can be subject to fatigue failure.

Figure 4:
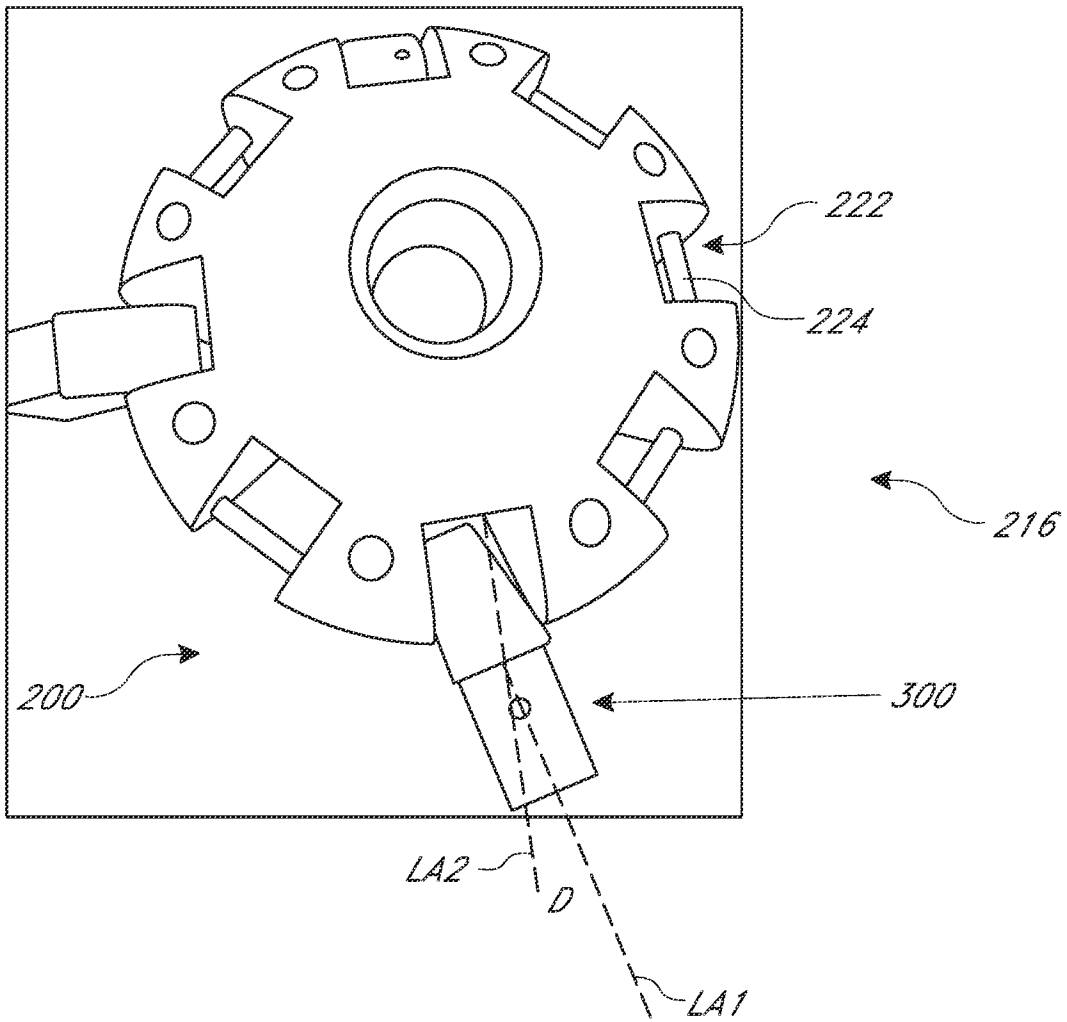
FIG. 4 is a top view of one embodiment of a hub assembly that can accommodate different rib orientations aligned with or diverging from radial directions of a hub thereof.

FIG. 4 shows a hub assembly 200 that can provide advantages in eliminating bending while still providing angulation for asymmetric umbrella configurations as in FIG. 3. The hub assembly 200 includes a hub 216 that has a plurality of channels 222 disposed along radial directions of the hub 216. The channel 222 can be provided with pin 224 to connect the upper ribs 108 thereto. The foregoing assumes that the hub 216 is an upper hub, but the hub 216 can be secured to the lower ribs 112 if the hub 216 is a lower hub. The channel 222 can be symmetrically disposed about the hub 216, e.g., extending along radial directions that are separated by equal angular distances, e.g., 45 degrees, 60 degrees, 90 degrees or other equal angular spacing. The channel 222 can have a common circumferential width at each position. The channel 222 can be configured to each receive a rib end connector 300 coupled with an elongate tubular member of a corresponding upper rib 108. FIG. 4 shows that the rib end connector 300 can be positioned along a longitudinal axis LA2 that is angled compared to a longitudinal axis LA1, which corresponds to a direction of a rib aligned with a radial direction of the channel 222. An angle D can be provided between the longitudinal axis LA1 and the longitudinal axis LA2. The angle D allows an upper rib 108 coupled with the channel 222 and angled as shown to reach a corner of a rectangular or other asymmetric umbrella structure, in a manner similar to that shown in FIG. 3 but without requiring bending within the rib end connector 300.

Figure 5:
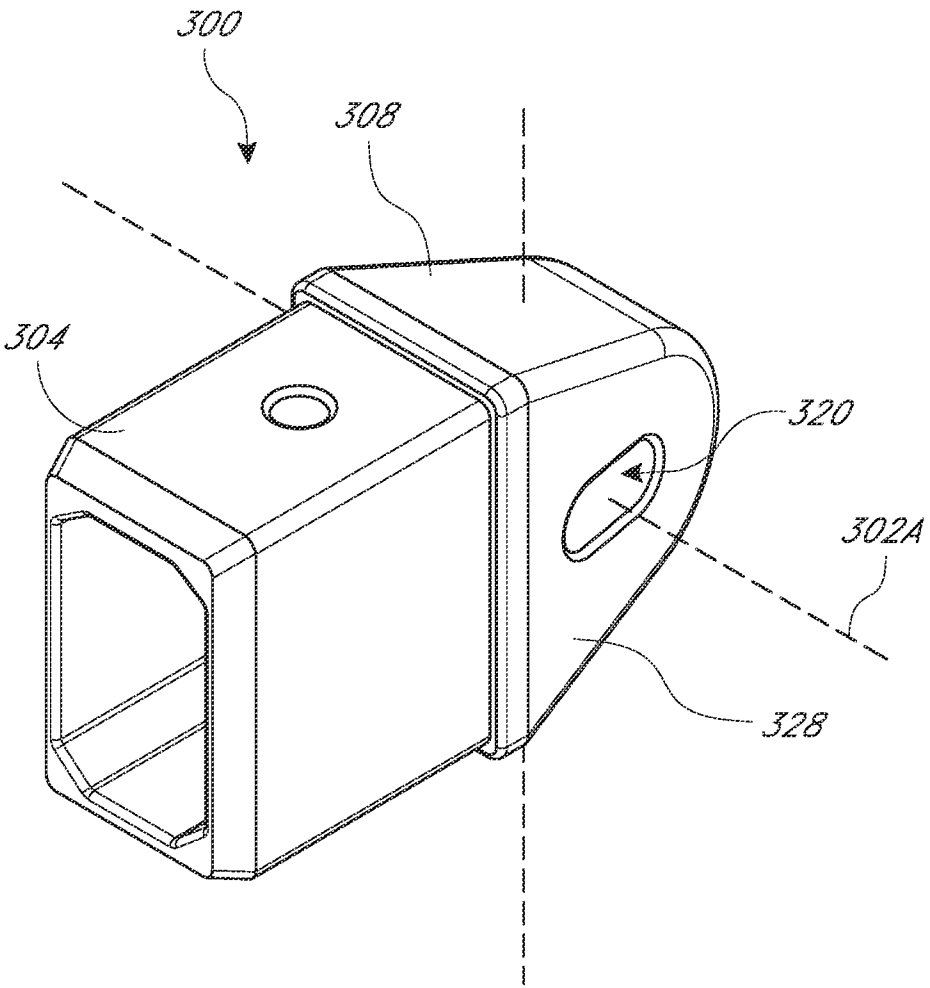
FIG. 5 is a perspective view of the rib end connector shown in FIG. 4.

FIG. 5 shows that the rib end connector 300 can include a rib connection portion 304 and a pin connection portion 308. The rib connection portion 304 can be configured to be coupled with a tubular member of the upper rib 108. For example, the tubular member can be open at the first (radially inner) end. The rib connection portion 304 can be a reduced thickness or reduced profile projection from or compared to the pin connection portion 308 such that the rib connection portion 304 can be inserted into the tubular member. The tubular member wall thickness and the reduced thickness or profile portion can be sized or configured such that the tubular member of the upper rib 108 is flush with the profile of the pin connection portion 308.

Figure 6:
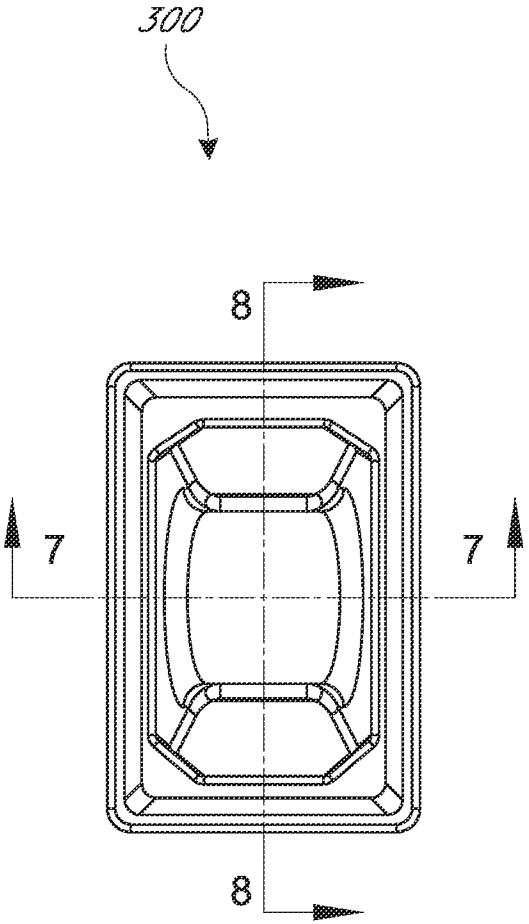
FIG. 6 is a free end view of the rib end connector shown in FIG. 4.

FIG. 6 shows that the rib end connector 300 can be tapered such that the end of the pin connection portion 308 opposite the rib connection portion 304 can be reduced profile compared to the location of the pin connection portion 308 adjacent to the rib connection portion 304. Specifically, opposing side surfaces 328 can taper towards each other as they extend away from the connection portion 304 and towards a distal end of the pin connection portion. The pin connection portion 308 can taper to a rounded nose portion that had a profile or size less than the profile or size of the rib connection portion 304.

Figure 8:
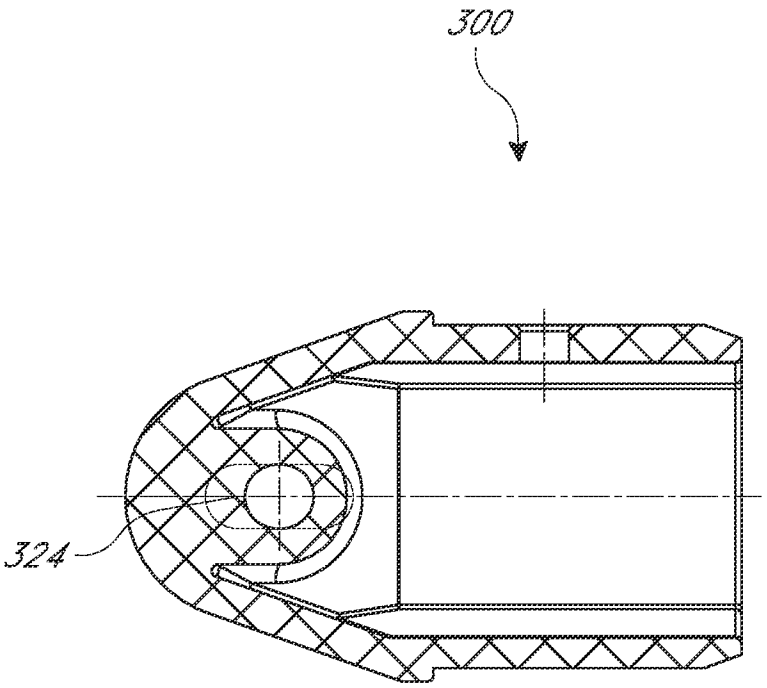
FIG. 8 is a cross-sectional view of the rib end connector shown in FIG. 6 taken at section plane 8-8.
Figure 7:
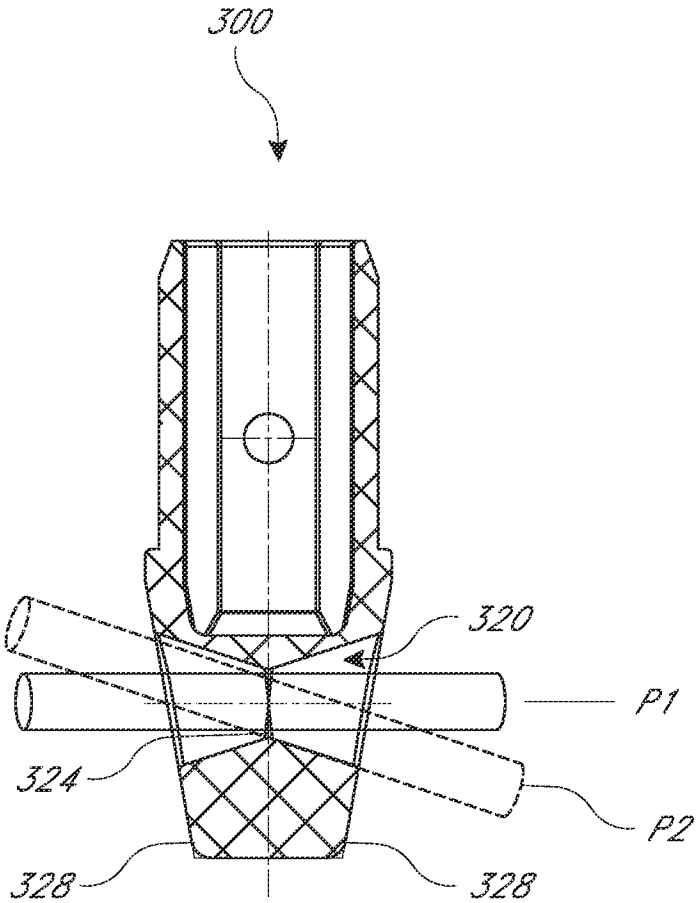
FIG. 7 is a cross-sectional view of the rib end connector shown in FIG. 6 taken at section plane 7-7 in FIG. 6.

FIGS. 7 and 8 shows that the rib end connector 300 has a varying size pin channel 320 disposed therethrough. The pin channel 320 can have a narrowest portion 324 disposed at a central portion of the rib end connector 300, e.g., along a longitudinal central plane of the rib end connector 300. The narrowest portion 324 can be sized to be slip fit over the pin 224 such that the rib end connector 300 can easily rotate about an axis that is perpendicular to the opening at the narrowest portion 324. That is the rib end connector 300 can rotate about the axis 302A (see FIG. 5) as the upper ribs 108 move when an umbrella with the hub assembly 200 is moved from open to closed. The pin channel 320 can enlarge in at least one direction away from the narrowest portion 324 (e.g., hourglass shaped). The pin channel 320 can enlarge in both directions away from the narrowest portion 324. The pin channel 320 can enlarge along a direction aligned with the rib connection portion 304 and the pin connection portion 308. The radially inner to radially outer dimension of the pin channel 320 can increase between the narrowest portion 324 and an opposing side surfaces 328 of the rib end connector 300. The increase in this dimension can be seen on both sides of the narrowest portion 324. FIG. 7 shows that the increase in this dimension can have an hourglass shape.

The pin channel 320 can have a constant height in one embodiment. In this context, the height is the dimension perpendicular to the radial dimension. The shape of the pin channel 320 at the opposing side surfaces 328 is oval with a major axis aligned with the radial direction and a minor axis transverse to the radial direction. The minor axis at the opposing side surfaces 328 can be equal to the radius of the opening at the narrowest portion 324.

In use, the shape of the pin channel 320 allows an upper ribs 108 including the rib end connector 300 coupled to the hub 216 to be angled away from a radial direction. The pin channel 320 can allow a pin orientation P1 (illustrated horizontally by solid lines in FIG. 7) to be transverse to the opening at the narrowest portion 324 and aligned with the axis 302A. The pin channel 320 can allow a pin orientation P2 (illustrated angled by dashed lines in FIG. 7) that provides the angle D seen in FIG. 4. The angle D is provided by rotating the rib end connector 300 about the axis 302B. The angle D can be achieved in the opposite direction by rotating the pin orientation P2 such that the right side portion thereof is above the direction P1.

The oval shape of the pin channel 320 provides that in some embodiments an upper rib 108 with the rib end connector 300 will tilt in only one direction in addition to open-close rotation about the pin 224. For example the upper ribs 108 disposed in a central portion of the channel 222, e.g., aligned with the horizontal mid-plane of the hub 216 can tilt in the circumferential direction of the hub 216 but will not tilt about the longitudinal axis of the upper rib 108. This one direction tilting allows the upper rib 108 to extend along a direction that can reach a corner portion of a rectangular or other asymmetric shape while another rib can extend along the radial direction to reach another portion of a periphery of a canopy fabric 102. By providing such tilting the rib end connector 300 is able to provide for angling the ribs without relying on bending of a connector.

In an alternative embodiment, the pin channel 320 lacks the narrowest portion 324. The pin channel 320 can extend from the first opposing side surface 328 to the second opposing side surface 328 forming a slot within the rib end connector having substantially the same cross sectional shape therethrough. The enlarged internal shape of the pin channel 320 can also accommodate the pin orientation P2. The tapered first and second opposing side surfaces 328 can accommodate angling of the connection portion 304 about the axis 302B within the inner walls of the channel 222. The slot formed by the pin channel 320 can accommodate angling of the connection portion 304 about the axis 302B on the pin 224.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A shade-structure rib apparatus, comprising:

a pin connection portion comprising a first end configured to be disposed in a channel of a shade structure hub, a second portion opposite the first end, a first side surface and a second side surface, a circumferential width of the pin connection portion being defined between the first side surface and the second side surface, and a pin channel disposed between the first side surface and the second side surface, the pin channel having a narrowest portion disposed between the first side surface and the second side surface, the pin channel increasing in size along at least one direction between the narrowest portion and the first side surface and/or the second side surface;

wherein the pin channel increases in size in a radial direction and has a constant height from the first side surface to the second side surface.

2. The shade-structure rib apparatus of claim 1, wherein the pin channel enlarges symmetrically from the narrowest portion to the first side surface and to the second side surface.

3. The shade-structure rib apparatus of claim 1, wherein the pin channel comprises an hourglass shape in longitudinal cross-section.

4. The shade-structure rib apparatus of claim 1, wherein at least one of the first side surface and the second side surface is tapered toward the first end.

5. The shade-structure rib apparatus of claim 1, wherein the first side surface and the second side surface are both tapered toward the first end.

6. The shade-structure rib apparatus of claim 1, wherein the second portion is configured to be secured to a tubular member of an umbrella rib to provide a rib assembly.

7. The shade-structure rib apparatus of claim 1, further comprising an elongate tubular member having an open end portion having the second portion dispose therein, the elongate tubular member having a free end configured to be coupled with a periphery of an umbrella canopy.

8. The shade-structure rib apparatus of claim 1, further comprising an elongate tubular member extending away from the second portion to a free end, the free end configured to be coupled with a periphery of an umbrella canopy.

9. A rib apparatus, comprising:

a pin connection portion comprising a first end configured to be disposed in a channel of a shade structure hub and a rib connection portion opposite the pin connection portion, the rib connection portion configured to be disposed within a shade-structure rib, the pin connection portion including a first side surface and a second side surface, the first side surface and the second side surface angled toward a central longitudinal plane of the pin connection portion such that the pin connection portion tapers toward a free end of the pin connection portion; and a pin slot disposed between a first end disposed on the first side surface and a second end disposed on the second side surface, the pin slot configured to allow angling of a pin received therein.

10. The rib apparatus of claim 9, wherein the pin slot increases in size from a narrowest portion towards the first side surface and the second side surface.

11. The rib apparatus of claim 9, wherein the pin slot has a constant height from the first side surface to the second side surface.

12. The rib apparatus of claim 9, wherein the pin slot has a constant width from the first side surface to the second side surface.

13. The rib apparatus of claim 9, wherein the pin slot comprises an hourglass shape in longitudinal cross-section.

14. The rib apparatus of claim 9, wherein the rib connection portion is configured to be secured to a tubular umbrella rib to provide a rib assembly.

15. The rib apparatus of claim 9, further comprising an umbrella rib having an open end portion with the rib connection portion dispose therein.

16. A shade-structure rib apparatus, comprising:

a pin connection portion comprising a free end configured to be disposed in a channel of a shade structure hub, a rib connection portion opposite the pin connection portion, a first side surface and a second side surface, a circumferential width of the pin connection portion being defined between the first side surface and the second side surface, and a pin channel disposed between the first side surface and the second side surface along the circumferential width, the pin channel comprising a fully enclosed circular perimeter in a central longitudinal cross-section of the pin connection portion disposed perpendicular to the pin channel at a center of the pin channel and the pin channel comprises an oblong area in a longitudinal cross-section of the pin connection portion disposed between the central longitudinal cross-section and the first side surface or between the central longitudinal cross-section and the second side surface.

17. The shade-structure rib apparatus of claim 16, wherein the pin channel increases in size continuously from the central longitudinal cross-section to the first side surface, from the central longitudinal cross-section to the second side surface, or from both the central longitudinal cross-section to the first side surface and from the central longitudinal cross-section to the second side surface.

18. The shade-structure rib apparatus of claim 16, wherein the pin channel comprises an enclosed oval-shaped perimeter disposed at the first side surface or at the second side surface, a major axis of the enclosed oval-shaped perimeter disposed in a plane disposed perpendicular to the central longitudinal cross-section and containing a central axis of the pin channel.

* * * * *